US005171196A

United States Patent [19]

Lynch

[11] Patent Number: 5,171,196

[45] Date of Patent: Dec. 15, 1992

[54] TREADMILL WITH VARIABLE UPPER BODY RESISTANCE LOADING

[76] Inventor: Robert P. Lynch, 10177 S. 77th East Ave., Tulsa, Okla. 74133

[21] Appl. No.: 837,249

[22] Filed: Feb. 14, 1992

Related U.S. Application Data

[60] Division of Ser. No. 641,479, Jan. 15, 1991, Pat. No. 5,104,119, which is a continuation-in-part of Ser. No. 478,059, Feb. 7, 1990, Pat. No. 5,000,440, which is a continuation of Ser. No. 292,886, Jan. 3, 1989, abandoned.

[51] Int. Cl.[5] ..... A63B 22/02

[52] U.S. Cl. ..... 482/7; 482/8; 482/54; 482/94

[58] Field of Search ..... 482/1-9, 482/51, 52, 54, 93, 94, 97, 112, 113, 121, 123, 129, 130, 133, 136, 137

[56] References Cited

U.S. PATENT DOCUMENTS

| | | | |
|---|---|---|---|
| 3,602,502 | 8/1971 | Hampl | 482/7 |
| 3,870,297 | 3/1925 | Elder | 482/7 |
| 4,278,095 | 7/1981 | Lapeyre | 482/7 X |
| 4,625,962 | 12/1986 | Street | 482/54 X |
| 4,635,927 | 1/1987 | Shu | 482/7 |
| 4,643,418 | 2/1987 | Bart | 482/5 |
| 4,708,337 | 11/1987 | Shyu | 482/54 |
| 4,749,181 | 6/1988 | Pittaway et al. | 482/54 X |
| 4,944,713 | 7/1990 | Salerno | 482/7 X |

*Primary Examiner*—Robert Bahr
*Attorney, Agent, or Firm*—Head & Johnson

[57] ABSTRACT

An exercising device combining an inclinable treadmill with an upper body exercising assembly having two or more sets of levers with handles. The resistance loading of each set of levers may be independently controlled and varied. This device combines strength training with aerobic exercise. Computerized controls and monitors are used. The device may be used in a weightless environment.

2 Claims, 11 Drawing Sheets

TREADMILL WITH VARIABLE UPPER BODY RESISTANCE LOADING

CROSS-REFERENCES TO RELATED APPLICATIONS

This is a divisional of copending application Ser. No. 07/641,479 filed on Jan. 15, 1991, now U.S. Pat. No. 5,104,119, which is a continuation-in-part of my prior application Ser. No. 07/478,059, filed Feb. 7, 1990 TREADMILL EXERCISE DEVICE COMBINED WITH WEIGHT LOAD, now U.S. Pat. No. 5,000,440, issued Mar. 19, 1991 and which is in turn a continuation of Ser. No. 07/292,886 filed on Jan. 3, 1989, now abandoned.

BACKGROUND OF THE INVENTION

1. Field of the Invention

This invention relates to the field of exercising devices.

2. Description of the Related Art

Treadmill exercising machines are well known and basically consist of a relatively wide endless moveable belt. By walking on this belt one may obtain aerobic level exercise. Some of these machines are powered by electrical motors and the speed is set at a desired rate for the exerciser. Other treadmills are not powered and the exerciser provides the motivating force. The general objective of these devices is to provide the cardio-pulmonary benefits of jogging or running. This type of conditioning is commonly known as aerobic. Treadmills may be set at a horizontal or level position or they may be inclined to cause more difficult exercise.

Various types of weight load exercisers are also well known, such as free weights, NAUTILUS machines, and the like.

My prior invention, application Ser. No. 07/478,059, combines a treadmill with upper-body weight loading. However, my prior invention uses a single variable resistance load for both upper and lower grips, and did not disclose a computer control. Further, my prior application does not specifically discuss use in a weightless environment (although it is usable therein).

Weightless environments (such as in space travel, or floating in fluid) present unique physiological problems to humans that are the result of prolonged exposure to the weightless environment. Exercise is essential to prevent osteoporosis of the bones and atrophy of the muscle. Elongation of the spine due to the lack of compressive force exerted by gravity is another serious problem.

SUMMARY OF THE INVENTION

It is an object of this invention to provide two, or more, sets of upper body exercising levers, in conjunction with an inclinable treadmill, each set of levers being independently moveable and with independently variable resistance from the other.

It is a further object of this invention to provide a variable computerized control and monitoring system to run and control the system.

It is still a further object of this invention to provide an exercise system that is usable in a weightless environment and will exercise all major muscles of the human body as well as providing compression of the spine.

In a broad sense, this invention is an exercising device which includes a treadmill and an upper body muscle exercising means supported by a frame attached to the base around the treadmill. By using this device I can provide aerobic conditioning combined with a system for strengthening the upper body muscle groups. The exercising device comprises a movable inclinable treadmill and two or more pairs of levers or handle bars which are pivotally connected to the upright support frame. Each lever handlebar pair has two handgrips preferably at approximately ninety degrees to each other; one handgrip is "inline" with the user, and the other is laterally placed in approximately perpendicular relation to the user. Pneumatic linear actuators, or other resistance means, are attached to the levers to provide independently variable resistance to movement of the levers. The treadmill may be powered by a motor so that it can be run at a variable selected speed. The treadmill is variably inclinable so as to be able to vary the angle to which the exerciser is subjected as he moves along on the treadmill. The inclination of the treadmill can be controlled by pneumatic means, by a motor activated screw, by a jack-like mechanism or by other suitable means. The control of the pneumatic actuators may be accomplished by an air pressure source.

The first set of handlebars is placed at about waist height and the second set is placed at a height which would be about shoulder height or higher. The upper set of handlebars enables the operator to lift the load by pushing in an upward position (pressing) as opposed to lifting or pulling upward which is done with the lower set of handlebars. Means are also provided to prevent the handlebars from dropping below essentially a horizontal position. Hydraulic/pneumatic cylinders, springs, elastic bands or other suitable devices may be used as the resistance means and are selectively variable for both the upper and lower sets of levers independently.

The control of the various parameters of the machine (angle of treadmill elevation, speed of treadmill, resistance, etc.) are preferably controlled, monitored and recorded by a computer.

In a weightless environment, the exercise device may be used as described above or modified to include a means of holding the user on the treadmill, and of supplying a downward compressive force on the user (toward the user's feet) to substitute for the lack of weight in the weightless environment.

The objectives are meant to be illustrative and not limiting. The manner of operation, novel features and further objectives and advantages of this invention may be better understood by reference to the following descriptions and drawings.

DESCRIPTION OF THE PREFERRED EMBODIMENT

Figure 1:
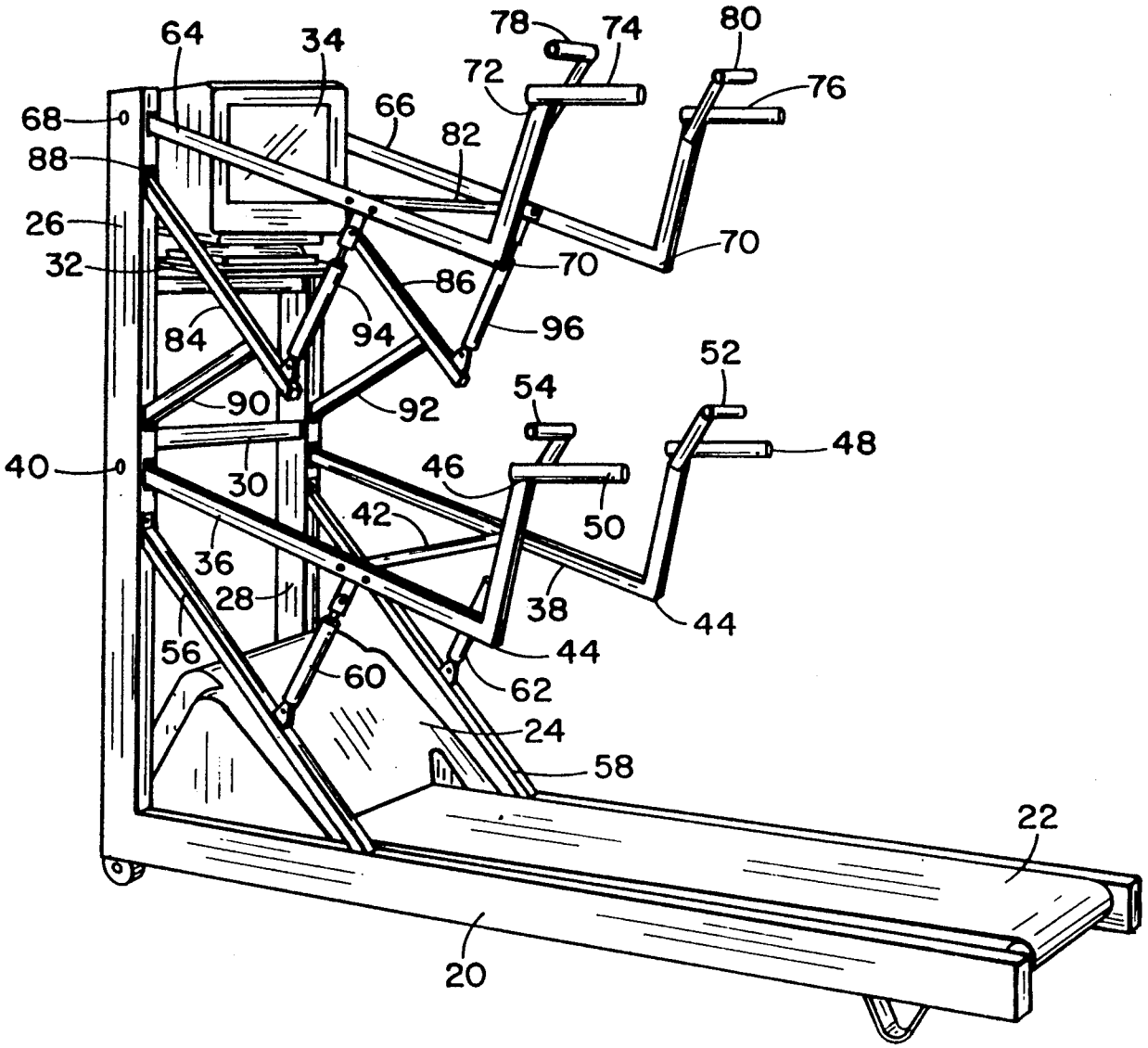
FIG. 1 is a perspective view of the exercise device.

FIG. 1 illustrates the exercise machine in prospective view. A base frame 20 holds an endless moveable treadmill belt 22. At the forward end of the base frame 20 a housing 24 covers the motor or motive means to drive the treadmill belt and to incline it (not shown in this figure). An upright support frame extends upward from the forward end of the base frame 20. In this embodiment, there is a left upright support frame member 26 and a right upright support frame member 28. Between these two upright support frames 26 and 28 there are one or more support frame cross bars 30 and a shelf 32 on which a television or video monitor 34 may be placed.

Still referring to FIG. 1, two sets of handle bars (upper and lower) are pivotally attached to the upright support frame members 26 and 28. The lower set will be discussed first. A left lower handle bar 36 and a right lower handle bar 38 are shown. The pivotal attachment of the left lower handle bar 36 is shown at 40 on the left upright support member 26. A lower handle cross bar 42 extends between the lower handlebars 36 and 38. The lower handlebars 36 and 38 turn upward at 44 then turn again at 46 to provide a handle, or support for a handle or handgrip 50, that is oriented generally perpendicular to the upright support frames 26 and 28. These handles are termed the right lower inline handle 48 and the left lower inline handle 50. These handles 48 and 50 are designed for a "wheelbarrow" type grip and lift. A second set of handles extends upwardly from these inline handles 48 and 50; a lower right lateral handle 52 and a lower left lateral handle 54. These later handles, 52 and 54, are preferably lateral or perpendicular to the inline handles, 48 and 50. These lower lateral handles 52 and 54 are suitable for various types of "curl" grips and exercises. These lower handles 48, 50, 52 and 54 are normally lifted with the arms pulling in tension and are normally located below the users waist.

Still referring to FIG. 1, there are two lower brace members, a left lower brace 56 and a right lower brace 58. These braces 56 and 58 are fastened at their upper ends to the upright support frames 26 and 28, and at their lower ends to the base frame 20. Pivotally fastened between the lower braces 56 and 58 and the lower handle bars 36 and 38 are two resistance cylinders; a left lower resistance cylinder 60 and a right lower resistance cylinder 62. These cylinders 60 and 62 provide variable resistance to movement of the lower handle bars 36 and 38. These cylinders may be pneumatic, hydraulic, or they may be replaced by springs, elastic bands, or other suitable motion resistive means.

Still referring to FIG. 1, the pair of upper handle bars will now be described. A left upper handle bar 64 and a right upper handle bar 66 are pivotally attached to the upright support members 26 and 28, with the left upper pivotal attachment shown at 68. The upper mechanism is analogous to the lower mechanism described above. The upper handle bars 64 and 66 turn upward at 70 at typically about 90 degrees but other convenient angles may be used. There is a second turn at 72, again at about 90 degrees or other convenient angle, to form the left upper inline handle 74 and the right upper inline handle 76. Projecting upward beyond the upper inline handles 74 and 76 are a left upper lateral handle 78 and a right upper lateral handle so. The upper lateral handles 78 and so are used for a military type press, and the upper inline handles 74 and 76 are used for an inward press. These upper handles 74, 76, 78, and so are normally at or above the users shoulder height and are pushed with the arms in compression.

There is an upper cross bar 82 between the upper handle bars 64 and 66. Below the upper handle bars 64 and 66, there are two braces, an upper left brace 84 and an upper right brace 86, which are attached to the upright support frame members 26 and 28 at their upper end, as shown at 88. The lower portion of both upper braces 84 and 86 are supported by struts, an upper left strut 90 and an upper right strut 92. These struts 90 and 92 are attached to the upright support frame 26 and 28 at one end and to the upper braces 84 and 86 at their other end. There are two upper resistance cylinders; left upper resistance cylinder 94 and right upper resistance cylinder 96 similar to the lower set 60 and 62. The upper set of cylinders 94 and 96 are pivotally fastened between the upper handle bars 64 and 66, and the upper braces 84 and 86 and provide a variable resistive means to movement of the upper handle bars 64 and 66.

Figure 2:
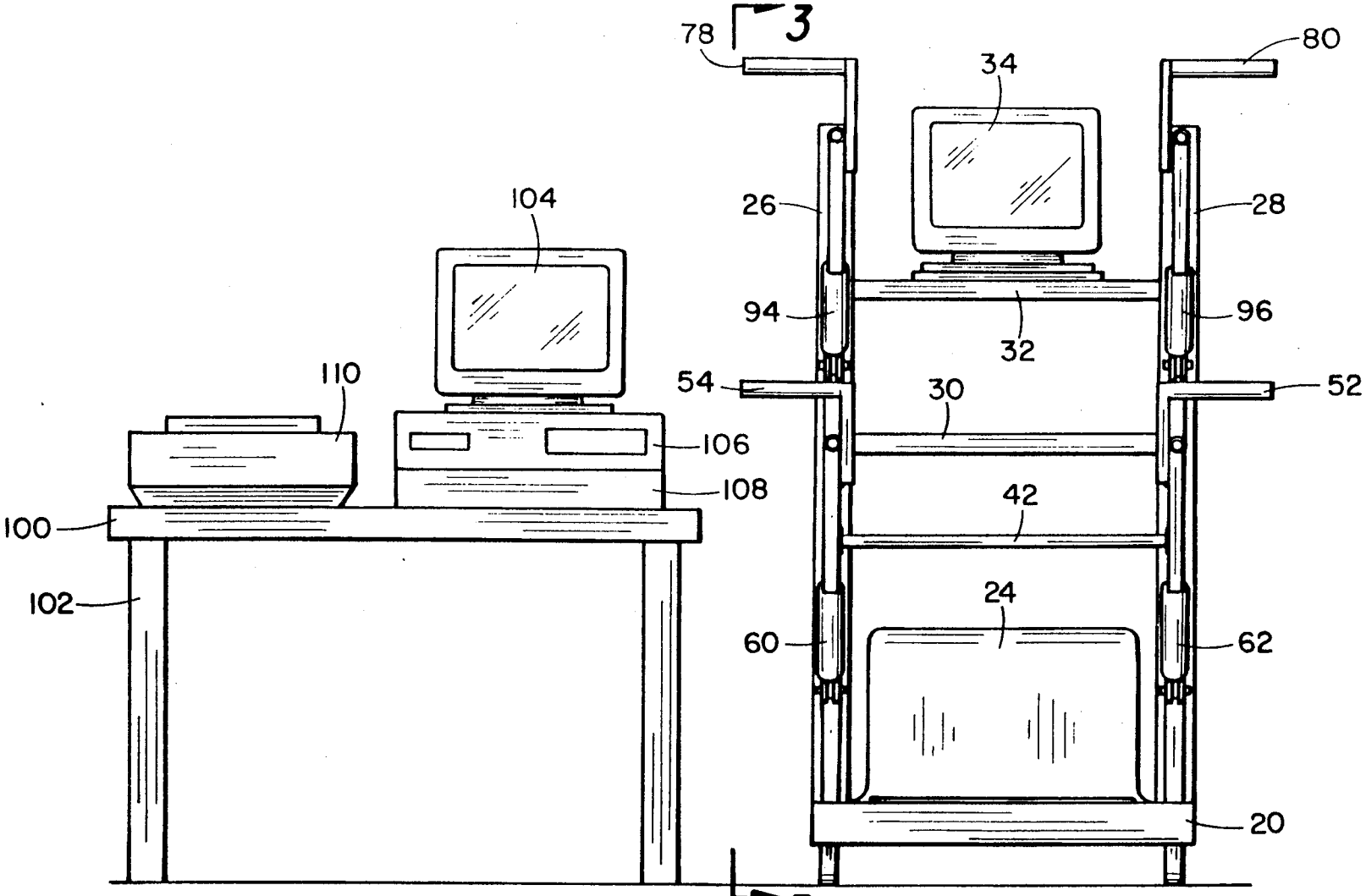
FIG. 2 is an end elevational view of the exercise device with attached computer control station (therapist station).

FIG. 2 illustrates the device in an end view, and further includes an operators computer/control station. There is a table top 100 with legs 102 on which a computer with screen 104, drive 106, keyboard 108, and printer 110 are supported.

Figure 3:
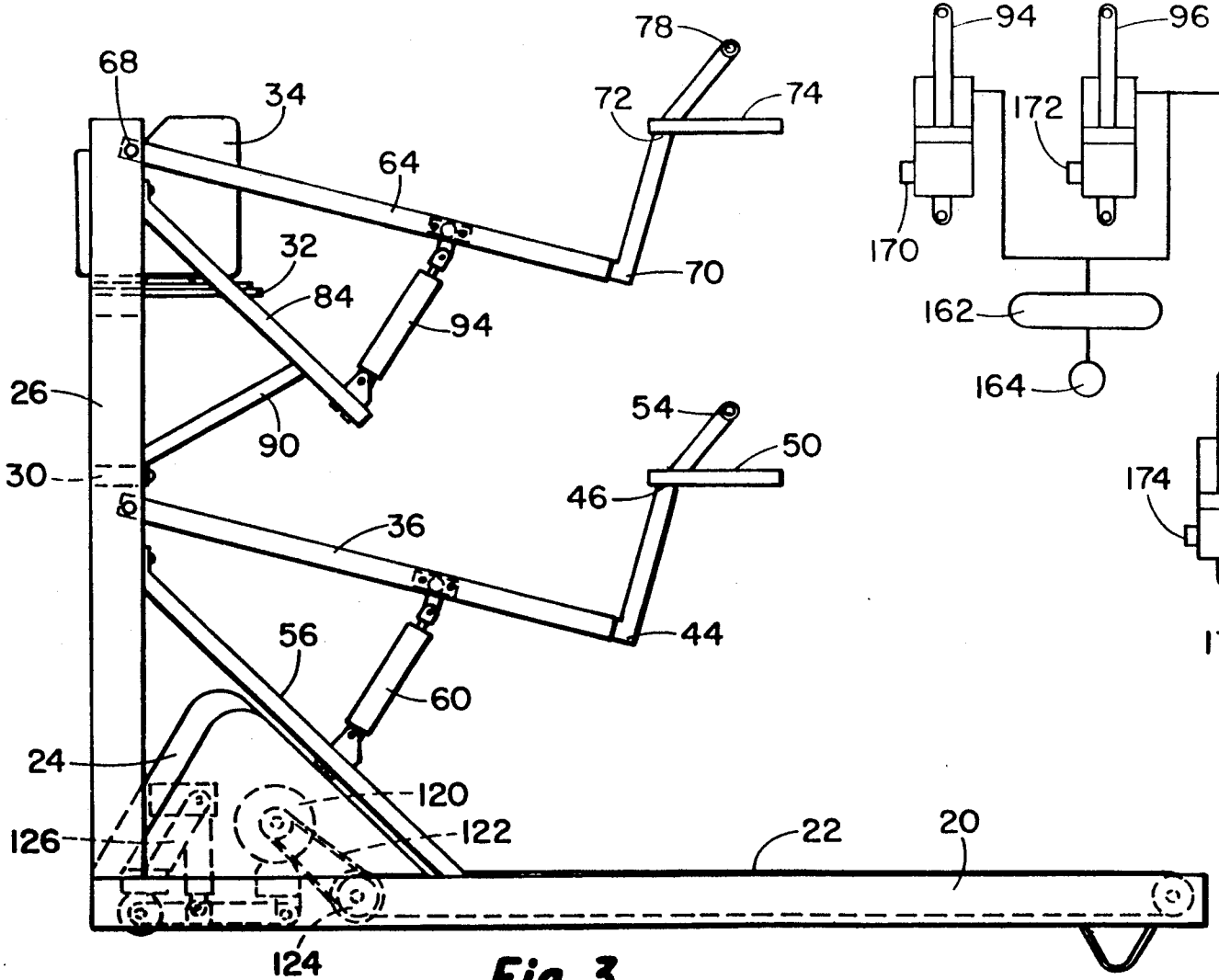
FIG. 3 is a side elevational view of the exercise device at line 3—3 in FIG. 2.
Figure 4:
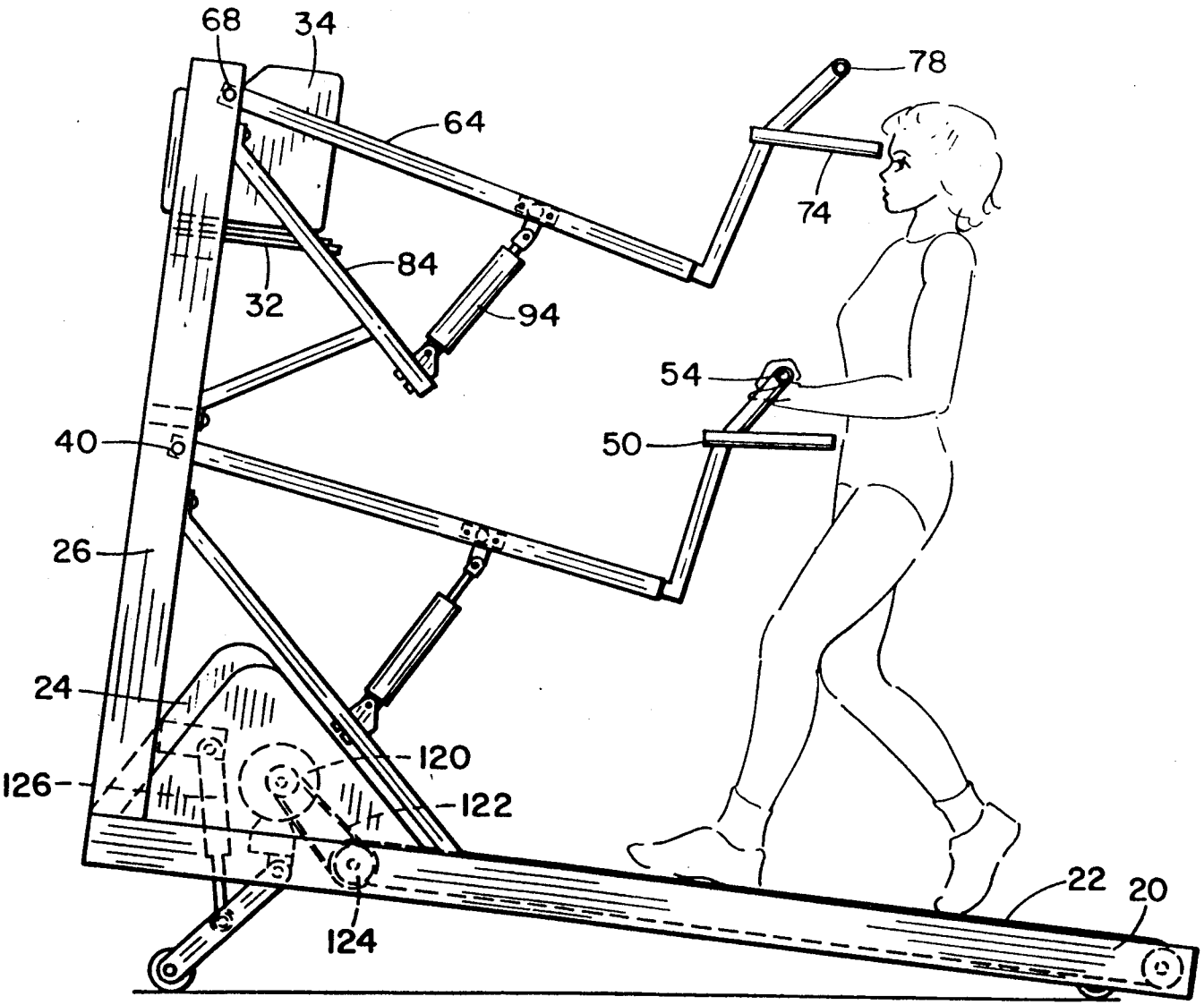
FIG. 4 is a side elevational view of the exercise device, in inclined position with user gripping lower curl handles.
Figure 5:
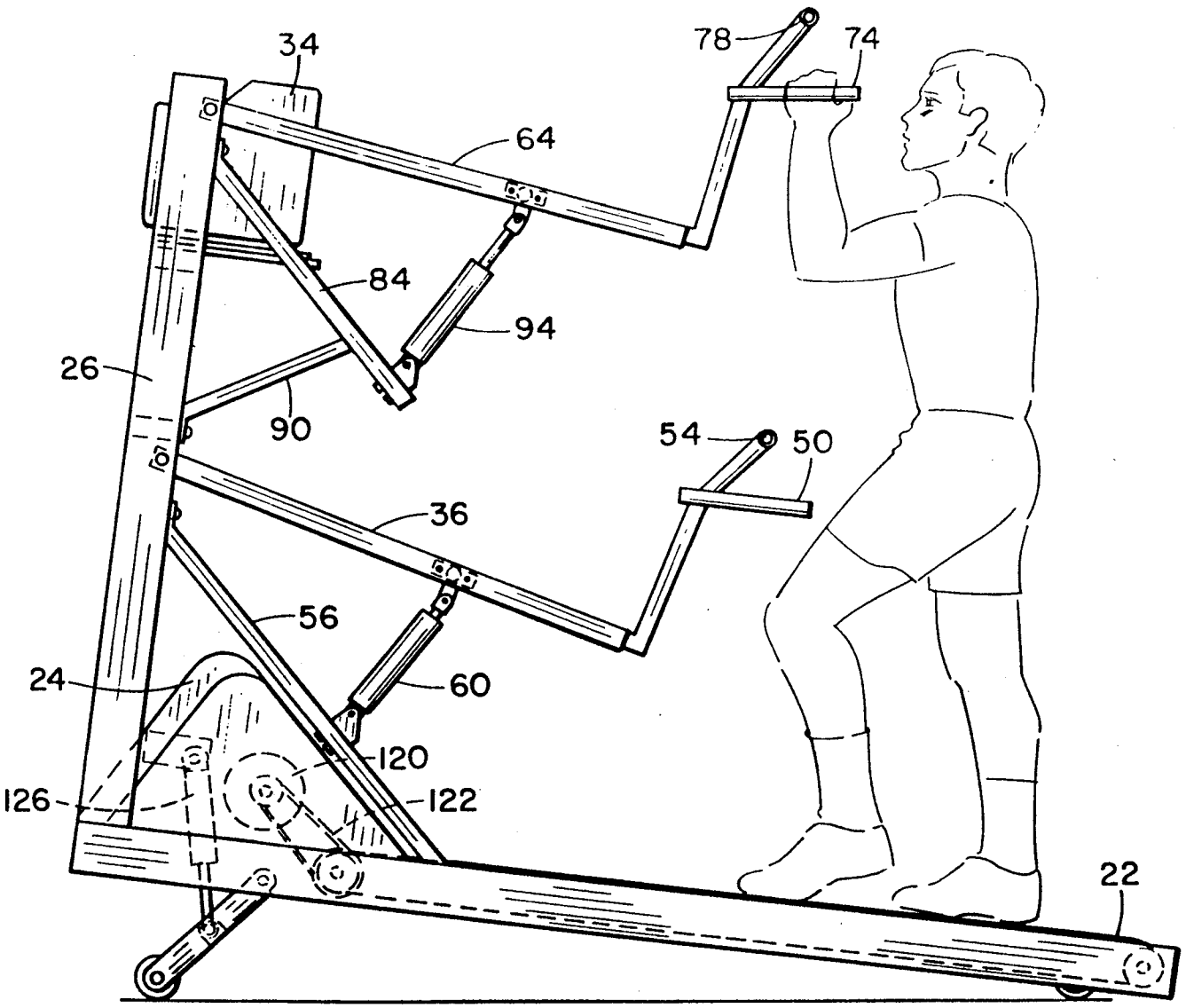
FIG. 5 is a side elevational view of the exercise device, in inclined position with user gripping upper inline handles.

FIG. 3 is a side view taken at line 3—3 in FIG. 2. In addition to the structure described above, this view also shows some of the internal components within the housing 24 at the forward end of the base frame 20. This includes a motor 120 with a belt/pulley 122 that can turn a spindle 124 which causes the endless belt 22 to move. There is also a lifting mechanism 126 within the housing 24 which can be used to lift the forward end of the belt 22 and base frame 20 so as to produce a sloping ramp (as seen in FIGS. 4 and 5). This lifting mechanism may be a lift jack or other suitable means.

FIG. 4 illustrates the device in side view with a user gripping the lower lateral handles (curl position) 54, and with the base frame 20 inclined at the forward end by the lift mechanism 126 to form a ramp.

FIG. 5 is similar to FIG. 4 but shows a user gripping the upper inline handle 74 in an inward press position.

Figure 6:
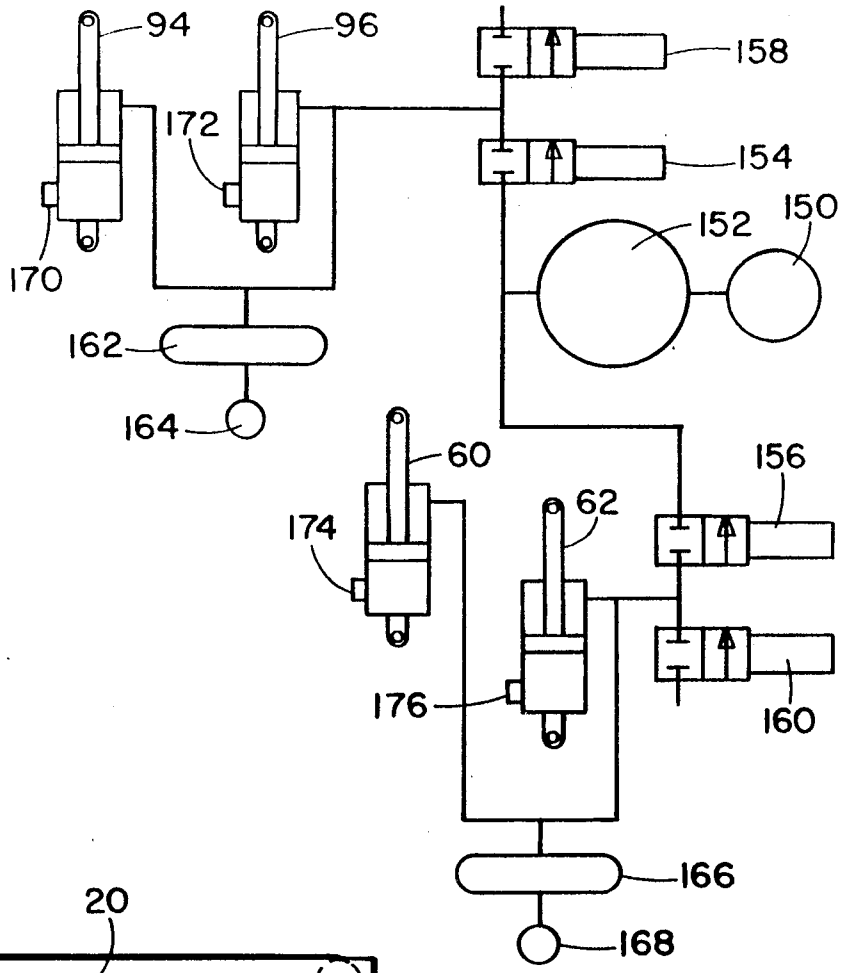
FIG. 6 is a schematic view of the pneumatic system used to control pressure in the resistance means.

FIG. 6 illustrates, in schematic form, the control system for the resistance cylinders 60, 62, 94, and 96. This includes a motor 150 and compressor 152 with an upper solenoid valve 154, that controls flow into the upper resistance cylinders 94 and 96, and a lower solenoid valve 156 that controls flow into the lower resistance cylinders 60 and 62. The charging fluid is preferably air. There is also an upper venting solenoid 158 and a lower venting solenoid 160 through which fluid may be discharged in the amount necessary to obtain a lower excess pressure in the cylinders. Connected to the air supply line, is an upper air receiver 162 and an upper pressure transducer 164. Also connected to the air supply line is a lower air receiver 166 and a lower pressure transducer 168. The pressure transducers are capable of providing a signal indicative cf the pressure in its associated air receiver. Magnetic switch sensors are provided to determine if the load is being lifted and thus provide a record of the user's performance. There is an upper left magnetic switch 170 attached to cylinder 94 and an upper right magnetic switch 172 attached to cylinder 96. Similarly, there may be a lower left magnetic switch 174 attached to cylinder 60 and a lower right magnetic switch 176 attached to cylinder 62. These magnetic switches detect movement of the piston within the resistance cylinder to which the switch is attached. Since the upper pair of resistance means 94 and 96 act in tandem, only one magnetic switch is necessary. Likewise, for the lower pair of resistance means 60 and 62, only a single magnetic switch is necessary for them too. Note that the magnetic switches in addition to noting the number of times the switch is activated, they also can monitor the length of time the activation is held.

As can be seen from the foregoing description, there are a number of independently variable parameters that can be changed when using this device:

1. Degree of inclination of treadmill.
2. Speed of treadmill belt.
3. Resistance load of lower handlebars.
4. Resistance load of upper handlebars.
5. Length of time used.
6. Number of repetitions.
7. Type of lift/grip position used:
   a. Wheelbarrow lift using the lower inline handles.
   b. Military press using the upper lateral handles.
   c. Curl lift using the lower lateral handles.
   d. Inward press using the upper inline handles.
   e. Reverse curl lift using the lower lateral handles.

In operation, the video monitor 104 displays a menu for selecting the various parameters listed above. After selection, using the keyboard 108, the exerciser uses the machine and the computer 106 controls the variables, as well as keeping a record of the variables, and of the number of "lifts" or "presses" done by recording the number of breaks in the magnetic switches 174 and 170 respectively.

Figure 7A:
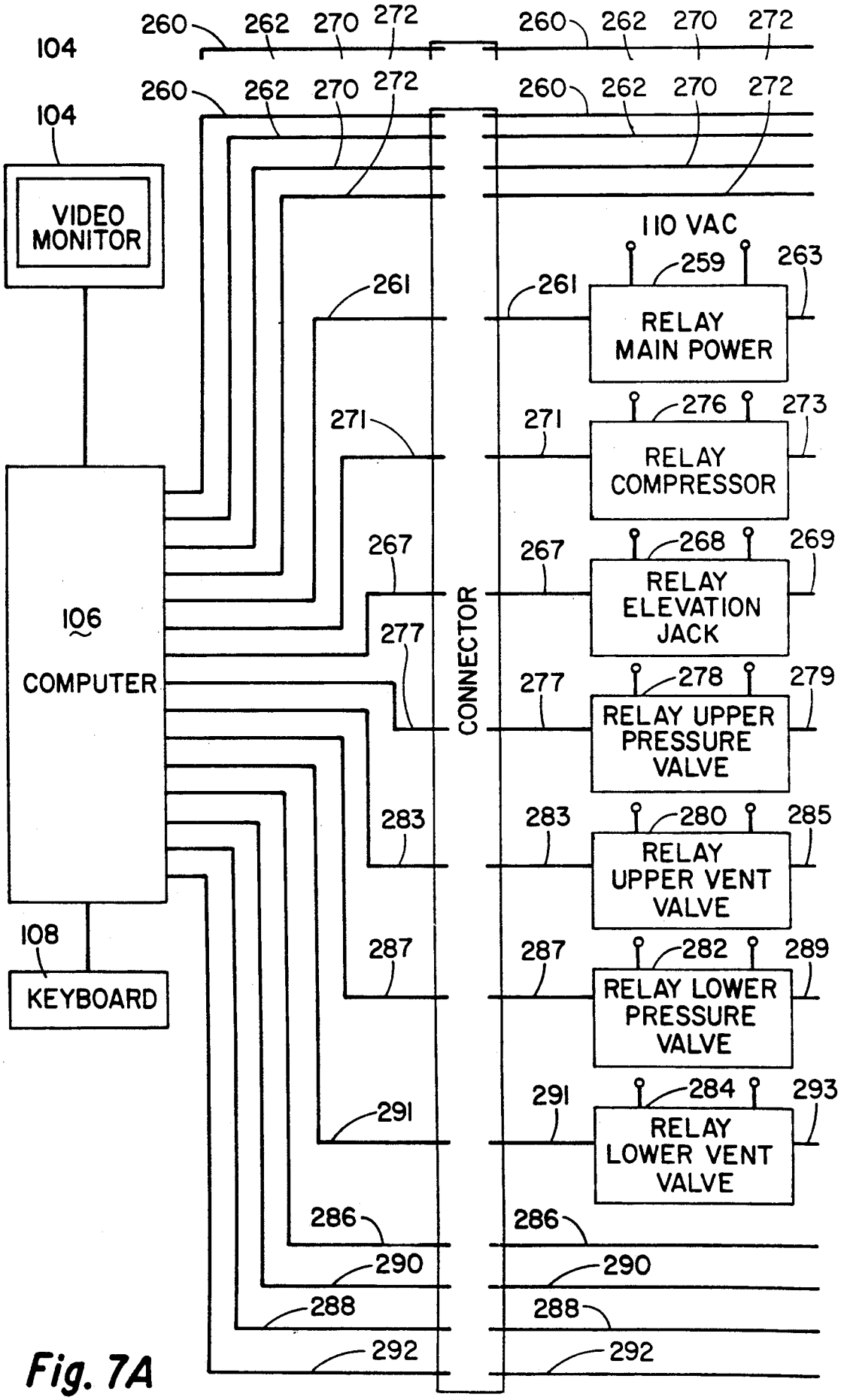
FIG. 7A is a schematic view of the control (computer) station and pneumatic and motor drive system of the device, and is part of a larger Figure completed in FIG. 7B.
Figure 7B:
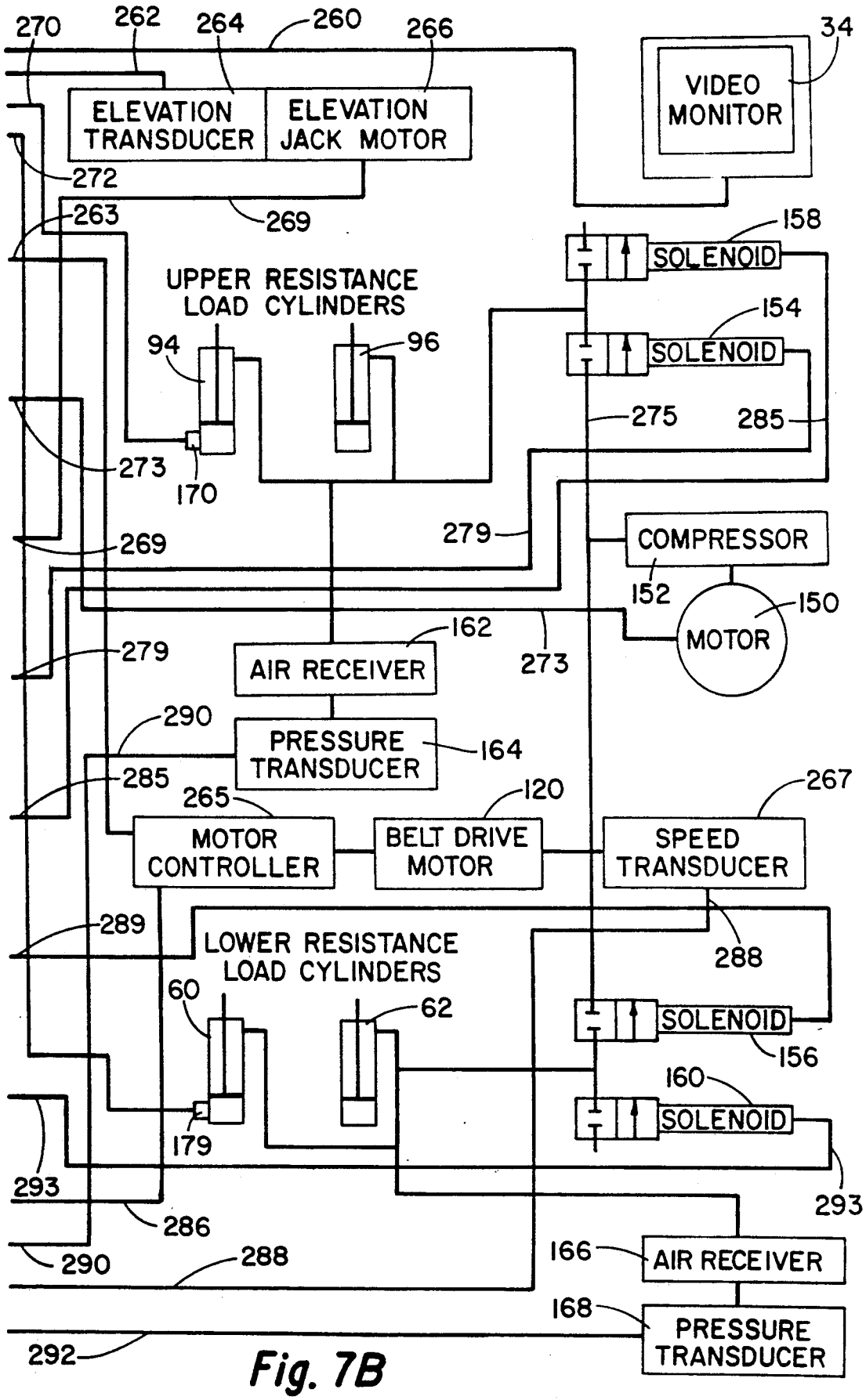
FIG. 7B is a continuation of the schematic view of FIG. 7A.

FIGS. 7A and 7B illustrate schematically how the computer system is connected to, and controls, the exercise device. The therapists station (or control station) includes the computer 106, display 104 and keyboard 108. Initially, after turning on the computer, the screen of the display 104 presents a menu from which the therapist or operator makes selections and thus controls the operation of the device. The pathways involved in this will now be described in detail, with reference to FIGS. 7A and 7B. Control parameters representing the desired setting for each of treadmill speed, treadmill/ramp elevation, upper resistance loading, lower resistance loading, air supply pressure, and time are given to the computer by the computer operator. If the variables, such as load, treadmill speed, etc., are to change after a period of time, information as to the length of this period and the value of the next set of variables is supplied to the computer. Preferably, this input into the computer is done in conjunction with a selection menu generated on the video monitor screen.

In FIG. 7A, the computer 106 is linked by line 260 to the video monitor 34 in FIG. 7B. This allows the exerciser/user to view his/her progress during the exercise. Power for the treadmill is controlled by the main power relay 259 and is connected to the computer 106 by line 261. Current from power relay 259 then travels by conduit 263 to the motor controller 265, which controls the treadmill belt motor 120 and runs it at the speed selected by the operator on the computer 106 (as described above). The speed is monitored by a speed transducer 267 which feeds a signal by line 288 back to the computer 106 which then compares the speed signal received from the transducer 267 with the desired speed that had been inputed into the computer. If there is a difference, the computer sends out a corrective signal, through conduit 286 to the motor controller 265 to either increase or decrease speed to conform to the desired input. It is well known for computers to compare a signal of a variable signal with a required control parameter and to provide a correction signal for making adjustments to certain functions so that the signal of the variable causes physical changes so that the variable signal is the same as the control signal.

The desired angle of treadmill inclination is controlled by imputing the desired value into the computer 106. Line 267 conveys the signal to the elevation jack relay 268 which feeds a signal along line 269 to the elevation jack motor 266 which raises or lowers the ramp in response to the signal by operating the lifting mechanism 126. This is monitored by the elevation transducer 264 which sends a signal representative of the actual inclination through line 262 back to the computer 106 for comparison and adjustment as needed.

Air pressure source for the upper and lower resistance cylinders 94, 96, 60 and 62 respectively, is obtained by initiating a motor start signal in the computer 106 which is transmitted through conduit 271 to the relay 276 which connects an electrical power source via conduit 273 to motor 150 which then drives compressor 152. The flow of pressure into, or out of, the resistance cylinders is controlled by the solenoids, as described below.

The computer 106, from the input data, sends a signal along path 277 to the relay for the upper pressure valve 278 then sends an electrical current via conduit 279 to the upper resistance input solenoid 154 and the current, by its presence or absence, opens or closes the valve therein to control (either permit or stop) the flow of air from the compressor 276 into the upper resistance cylinders 94 and 96. The air receiver 162 is connected fluidly to the pressure source for the upper lead cylinders. The transducer 164 sends a signal along path 290 to computer 106 to compare the actual and input control resistance values, and to adjust accordingly. In the event the pressure is too high, a signal from the computer 106 is transmitted on conduit 283 to the upper vent valve relay 280. This closes a power circuit so that electrical current is transmitted over conduit 285 to the upper resistance output solenoid 158 which, when energized, opens a valve allowing the excess pressure to be vented. If the pressure as measured by the transducer 164 is too low, then the upper resistance input solenoid 154 is activated to open the input valve and to provide more pressure into the cylinders. This is accomplished by the computer 106 transmitting a control signal over conduit 277 to relay 278. This closes the power circuit and energizes solenoid 154 to open it so that high pressure air may be supplied to the load cylinders 94 and 96. Solenoids 154, 158, when energized opens its respective normally closed valves.

A similar system operates for the lower resistance cylinders. The same motor 150 and compressor 152 is used. A signal denoting the desired resistance load is sent from the computer 106 along conduit 287 to the lower pressure valve relay 282 causing the relay to close and allowing current to flow along conduit 289 to the lower resistance input solenoid. The current flow opens the valve in the cylinder and allows pressurized air to enter. As in the above, a lower air receiver 166 and transducer 168 are in the flow path and provide a feedback signal along conduit 292 to the computer. If pressure needs to be decreased, then a signal is sent along conduit 291 to the lower vent valve relay 284 and thence along conduit 293 to the lower resistance venting solenoid 156 which opens valves in the cylinders 60 and 62 thereby allowing excess pressure to be released. Conversely, if the pressure is too low, the aforementioned pathway 287, 282, 289 is again actuated to cause more air pressure to enter the cylinders 60, 62.

Also illustrated on FIG. 7B are an upper break switch 170 and a lower break switch 179 mounted on the resistance cylinders which allows the computer to determine the number of "lifts" made on each cylinder (by recording the number of breaks) and the duration that the "lift" is held (by recording the length of time the break is open), this signal is fed to the computer by paths 270 (upper) and 272 (lower).

One use for this invention is in the field of orthopedic therapy. Orthopedic therapists commonly prepare an "exercise prescription" when a patient is to be put through a series of exercises. This prescription can include any or all of the above variables. In a manual mode, the therapist must individually monitor the patient and change the settings on the machine; thus, in effect, a therapist to patient ratio of one to one is needed, which is an inefficient use of the therapist. In contrast, the use of a computer controlled system allows the therapist to preset parameters, to monitor multiple machines, and to keep a record of performance data.

A typical exercise prescription that could be used is as follows:

| | |
|---|---|
| Warm Up: | |
| Belt speed = 2.0 MPH. | |
| Time = 1.0 min. | Ramp angle = 0 degrees |
| Belt speed = 3.0 MPH. | |
| Time = 2.0 min. | Ramp angle = 0 degrees |
| Belt speed = 3.5 MPH. | |
| Time = 2.0 min. | Ramp angle = 0 degrees |
| Circuit No. 1: | |
| Lift wheelbarrow handles, | Load = 30 lbs. |
| Belt speed = 2.5 MPH. | Time = 15 sec. |
| Ramp angle = 5 degrees. | |
| Lift military press handles, | Load = 20 lbs. |
| Belt speed = 2.5 MPH. | Time = 15 sec. |
| Ramp angle = 5 degrees. | |
| Lift curl position handles, | Load = 30 lbs. |
| Belt speed = 2.5 MPH. | Time = 15 sec. |
| Ramp angle = 5 degrees. | |
| Lift inward press handles, | Load = 20 lbs. |
| Belt speed = 2.5 MPH. | Time = 15 sec. |
| Ramp angle = 5 degrees. | |
| Lift reverse curl position, | Load = 30 lbs. |
| Belt speed = 2.5 MPH. | Time = 15 sec. |
| Ramp angle = 5 degrees. | |
| Rest: | |
| Time = 1 min. | Belt speed = 3.5 MPH. Ramp angle = 0 degrees. (No lifting). |
| Circuit No. 2: | |

-continued

| | |
|---|---|
| Lift wheelbarrow handles, | Load = 40 lbs. |
| Belt speed = 3.5 MPH. | Time = 15 sec. |
| Ramp angle = 5 degrees. | |
| Lift military press handles, | Load = 30 lbs. |
| Belt speed = 3.5 MPH. | Time = 15 sec. |
| Ramp angle = 5 degrees. | |
| Lift curl position handles, | Load = 40 lbs. |
| Belt speed = 3.5 MPH. | Time = 15 sec. |
| Ramp angle = 5 degrees. | |
| Lift inward press handles, | Load = 30 lbs. |
| Belt speed = 3.5 MPH. | Time = 15 sec. |
| Ramp angle = 5 degrees. | |
| Lift reverse curl position, | Load = 40 lbs. |
| Belt speed = 3.5 MPH. | Time = 15 sec. |
| Ramp angle = 5 degrees. | |
| Rest: | |
| (set parameters as desired) | |
| Circuit No. 3: | |
| (set parameters as desired, like example above) | |
| (use as many rest times and Circuits as needed) | |

Figure 8:
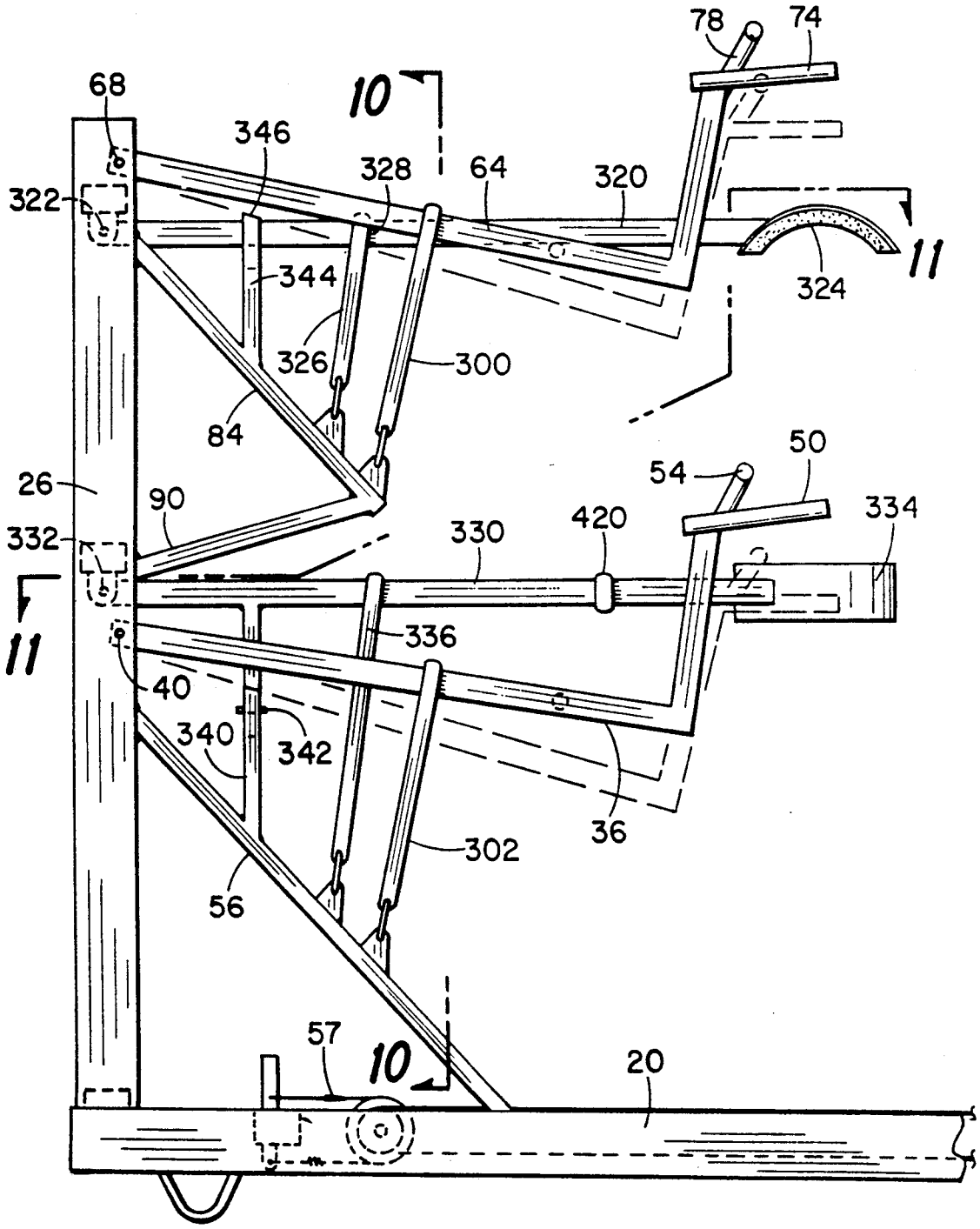
FIG. 8 is an elevational sideview of the device adapted for a weightless environment, with the weight lifting arms in the extended position.

FIG. 8 illustrates an embodiment of my invention for use in a weightless environment. The base 20, support frame 26, lower handle bar 36 and upper handle bar 64 are the same as described above. The dotted lines in this figure show the upper and lower handlebars in the rest position. Indeed, my invention as described above, and in my prior application Ser. No. 07/478,059, may be used in a weightless environment without any modification. However, the downward compressive force on the user is then equal to the resistance of either the upper resistance band 300 or the lower resistance band 302, which ever is being used. In a weightless environment, that is also a vacuum or partial vacuum, bands 300,302 formed of elastic material or springs are used to provide the resistance. Otherwise, the resistance cylinders 60, 62, 94 and 96 (as shown in FIGS. 1 and 3) may be used.

If it is desired to provide greater compressive force to the user (such as his or her full body weight) in the weightless environment, the device may be modified to provide means for pushing or pulling downward on the user. In the embodiment shown in FIG. 8 a shoulder bar 320 is pivotally attached to a crossbar (seen in FIG. 10) attached to frame 26 at 322. The shoulder bar 320 ends in a curved shaped padded shoulder pad 324 designed to lie on top of the shoulder of the user (a similar mechanism is present of the right side). A resistive band (or spring) 326, of suitable elastic material, is attached around the shoulder bar 320 and the upper left brace 84 and pulls the pad 324 downward on the shoulder. The band 326 is slidably attached to the bar 320 at 328. Thus, by moving the position of the band 326 along the bar 320, greater, or lesser downward force may be exerted on the shoulder.

A similar arrangement is shown for the lower levers. A waist bar 330 is pivotally attached to a crossbar (seen in FIG. 10) attached to the frame 26 at 332 with the other end of the bar 330 ending in a curved member 334 that fits partially around the user's waist or hips. As with the above shoulder bar, a resistive band (or spring) 336 is slidably attached between the waist bar 330 and the left lower brace 56 so that variable downward force may be attached to the user. Similar means are also present on the right side (not shown in this view). Also, a stepped support rest 340 is provided for stopping the downward movement of the handle bar 36 by the pin 342. A similar rest 344 is shown for the upper handle bar 64 with the rest stop being the top 346. Note also, that in this weightless configuration, a flywheel with an adjustable drag brake 57 has been added to regulate the movement of the treadmill in a gravity free environment. An alternative means of providing compressive force on the user, is to have elastic bands or springs attached to the base of the device to pull down on the user (not illustrated).

Figure 9:
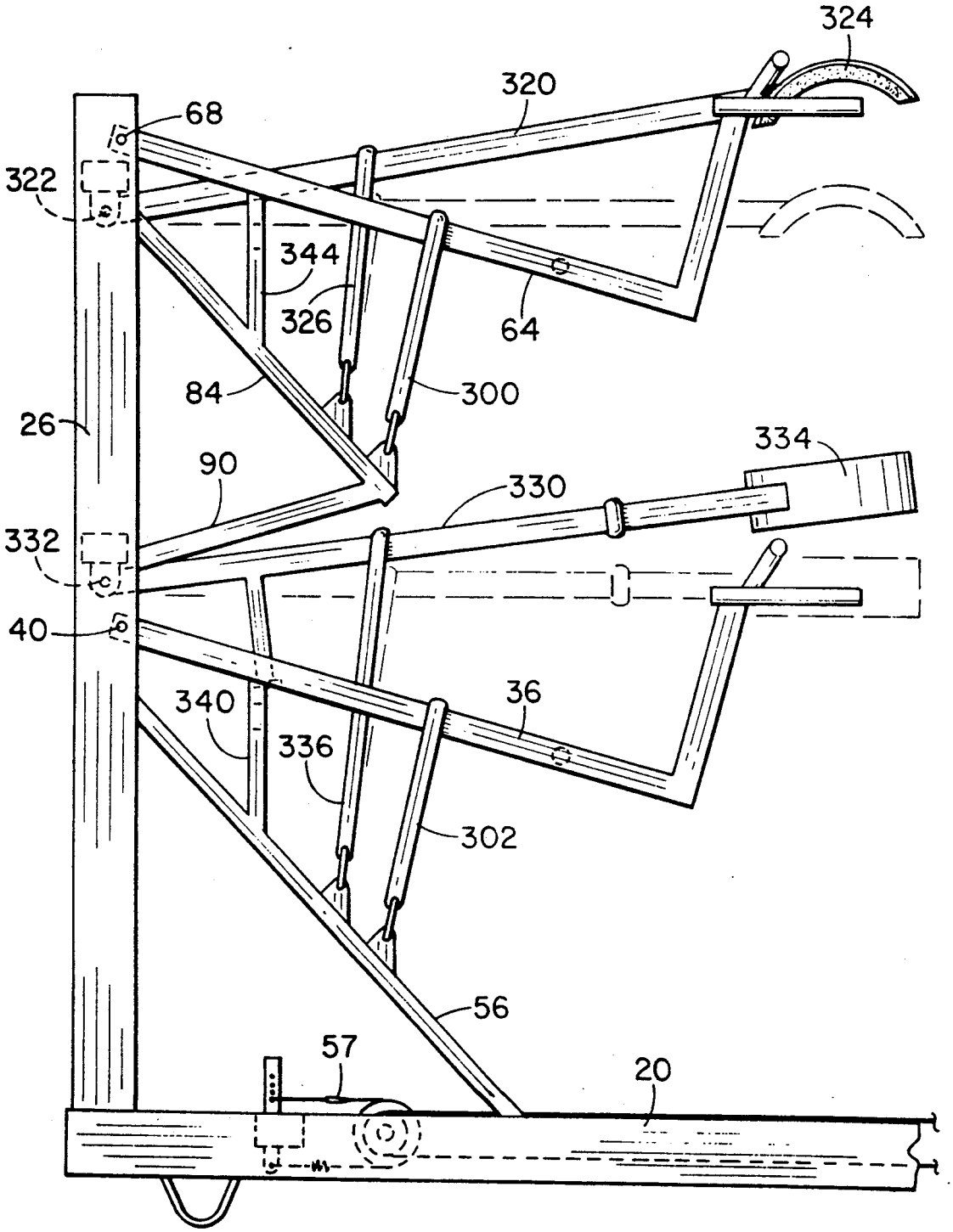
FIG. 9 is an elevational sideview of the device adapted for a weightless environment, with the shoulder and waist restraining means in the extended position.

FIG. 9 illustrates the device as shown in FIG. 8 but with the upper shoulder arm 320 and the waist arm 330 in the upright/extended positions, the resting positions of each are shown by the dotted lines.

Figure 10:
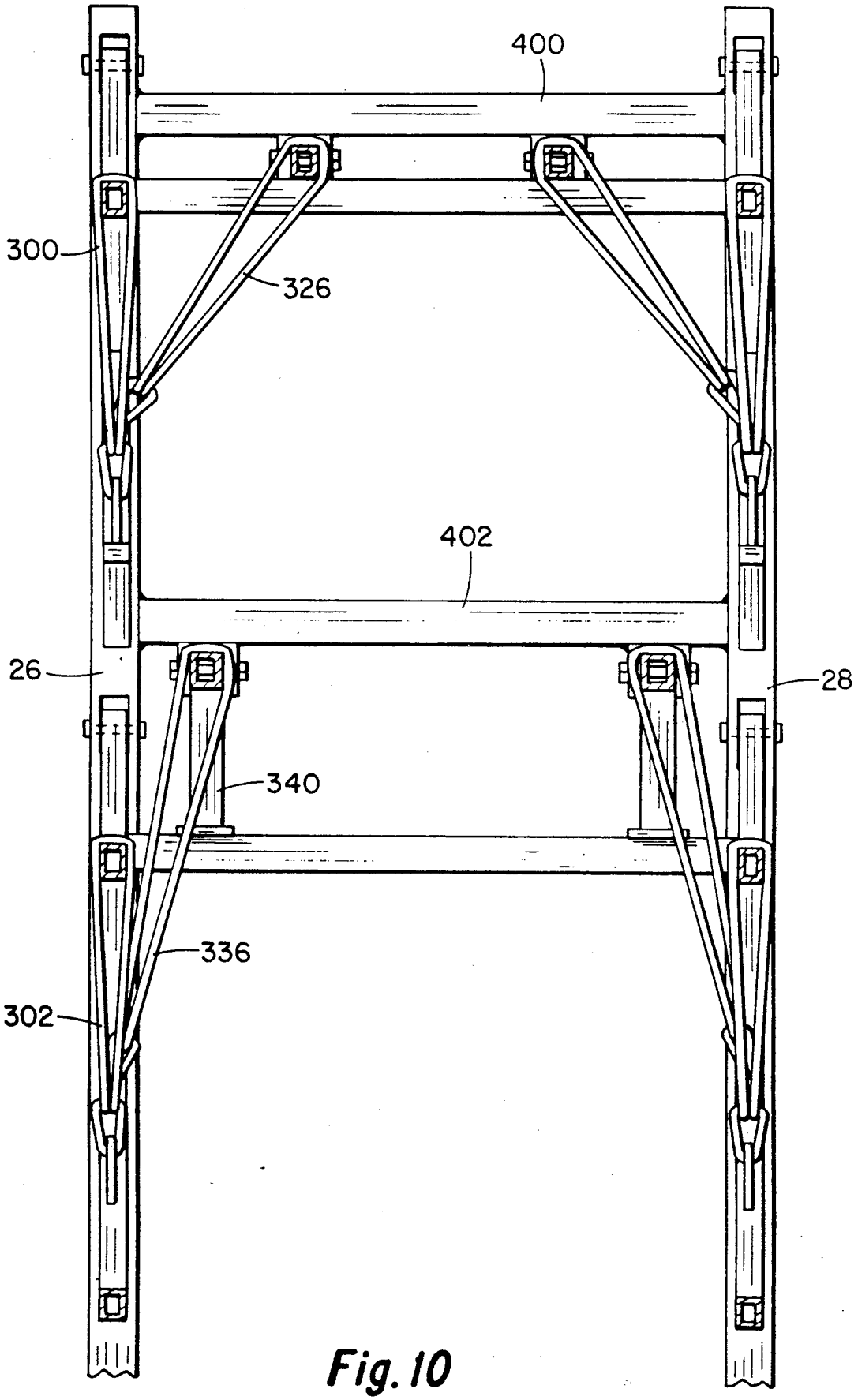
FIG. 10 is an end elevational view of the device modified for a weightless environment taken along line 10—10 in FIG. 8.

FIG. 10 is an elevational end view taken along line 10—10 in FIG. 8. In this view, the upper crossbar 400 and the lower crossbar 402 to which the shoulder bar 320 and the waist bar 330 are attached respectively can be seen. The right sided resistance bands can also be seen in this view.

Figure 11:
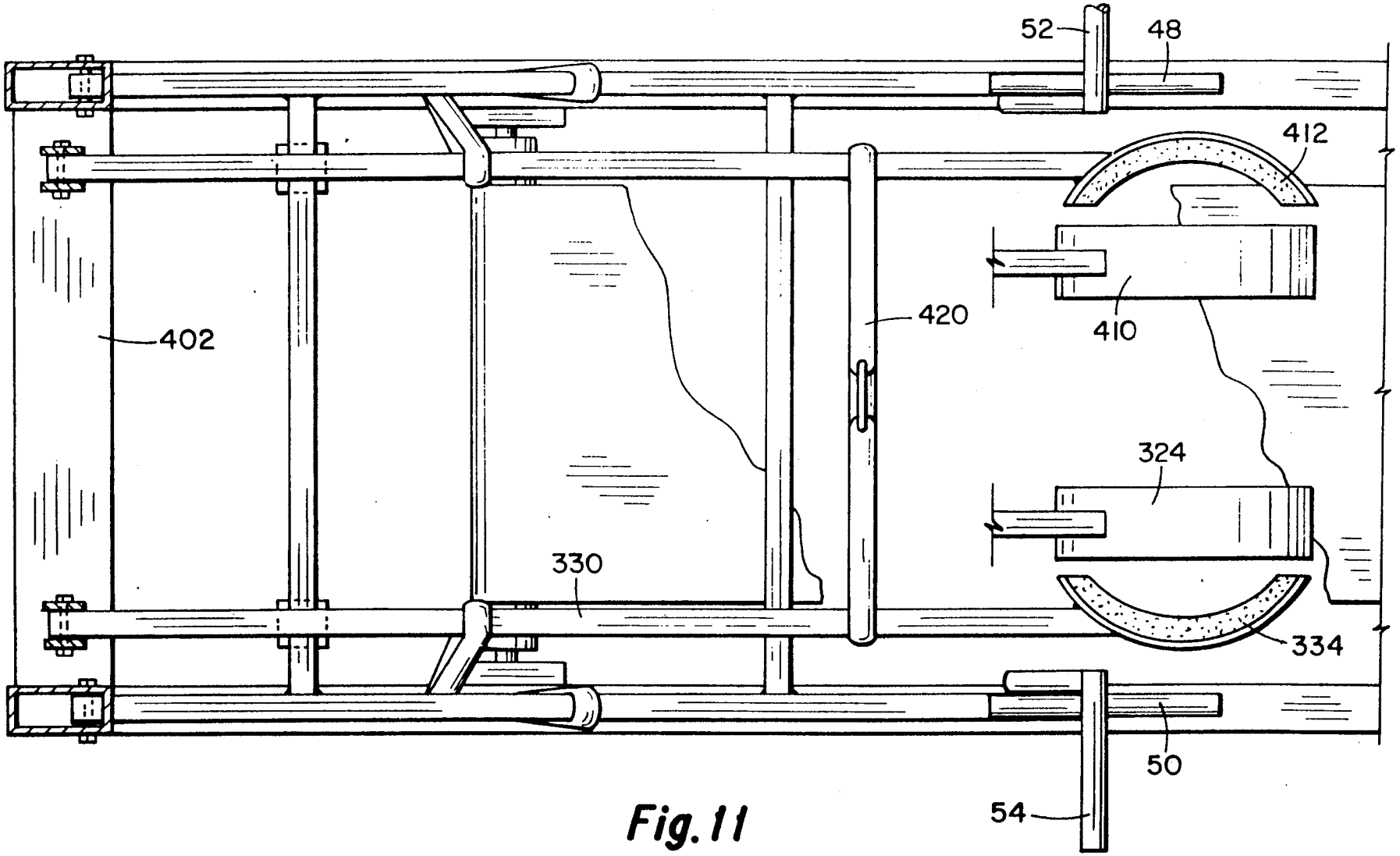
FIG. 11 is a top view along line 11—11 in FIG. 8.

FIG. 11 is a top plan view along line 11—11 of FIG. 8 and shows the top of the left shoulder pad 324 as well as the top of the right shoulder pad 410. Likewise, the curved configuration of the left waist pad 334 and the right waist pad 412 is seen. An additional elastic band 420 is shown that functions to force the waist pads 334 and 412 inwardly onto the users waist.

In use, the shoulder and waist pads may be used separately, or together. As mentioned above, without the use of these pads, in a weightless environment, only the lifted or pressed weight is transmitted to the user, while the use of these pads allows the missing body weight to be supplied. In the preferred embodiment, both shoulder and waist pads would be used.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A method of using a combination treadmill and weight lifting exercise device in conjunction with a computer comprising:

(A) inputing control values into the computer for each exercise device parameter including angle of treadmill inclination, treadmill speed, a first resistive force for moving a first resistive element relative to the weight lifting exercise device;

(B) obtaining a continuous actual measurement of each of the control parameters listed in step (A);

(C) comparing the control parameters of step (A) with the measurements of step (B); and (D) adjusting any one or all of the angle of treadmill inclination, the treadmill speed, the first resistive forces individually in response to the comparison made in step (C) until the measurement of each equals the appropriate control value.

2. A method of using a combination treadmill and weight lifting exercise device in conjunction with a computer comprising:

(A) inputing control values into the computer for each exercise device parameter including angle of treadmill inclination, treadmill speed, a first resistive force for moving a first resistive element, a second resistive force for moving a second resistive element;

(B) obtaining a continuous actual measurement of each of the control parameters listed in step (A);

(C) comparing the control parameters of step (A) with the measurements of step (B); and (D) adjusting each of the angle of treadmill inclination, the treadmill speed, the first and the second resistive forces individually in response to the comparison made in step (C) until the measurement of each equals the appropriate control signal.

* * * * *